United States Patent [19]

Mihirogi

[11] 4,109,584

[45] Aug. 29, 1978

[54] TRACK SWITCHING DEVICE FOR TWO-RAIL TYPE TRACKS

[75] Inventor: Kiyoshi Mihirogi, Odawara, Japan

[73] Assignee: Japan Airlines Co., Limited, Tokyo, Japan

[21] Appl. No.: 753,365

[22] Filed: Dec. 22, 1976

[51] Int. Cl.[2] ..... E01B 7/00; E01B 25/12

[52] U.S. Cl. ..... 104/130; 104/99; 104/101; 104/102; 246/415 R

[58] Field of Search ..... 104/48, 49, 96, 99, 104/101, 102, 104, 130; 246/415 R, 419

[56] References Cited

U.S. PATENT DOCUMENTS

| | | | |
|---|---|---|---|
| 1,671,971 | 6/1928 | Cooper | 246/419 X |
| 3,204,575 | 9/1965 | O'Donnell | 104/130 X |
| 3,735,709 | 5/1973 | Matsumoto et al. | 104/130 |
| 3,774,544 | 11/1973 | Mouillon | 104/130 |
| 3,905,302 | 9/1975 | Fink et al. | 104/130 |
| 3,905,568 | 9/1975 | Watanabe et al. | 104/130 X |

FOREIGN PATENT DOCUMENTS

| | | | |
|---|---|---|---|
| 1,575,761 | 6/1969 | France | 104/130 |

*Primary Examiner*—Randolph A. Reese
*Attorney, Agent, or Firm*—Armstrong, Nikaido, Marmelstein & Kubovcik

[57] ABSTRACT

A track switching device for selectively coupling a first track to one of second and third tracks. The switching device comprises a plurality of movable members, one of which has two parallel rails which operate such that when it is moved, the two rails are moved between the outer rails of the second and third tracks so that a selected one of the rails on the movable member is coupled to a selected one of the inner rails of the second and third tracks.

4 Claims, 9 Drawing Figures

TRACK SWITCHING DEVICE FOR TWO-RAIL TYPE TRACKS

BACKGROUND OF THE INVENTION

This invention relates to track switching devices provided for two-rail type tracks adapted to support and guide magnetic floating type rolling stock employed in ultra-high speed railway transportation.

In an ordinary railway, rolling stock is supported, guided, and driven by the combination of wheels and rails. However, in an ultra-high speed railway, the function of supporting and guiding the rolling stock and the function of driving the same are provided separately from each other.

A magnetic floating system of magnetically floating rolling stock in which a magnetic force is employed to support and guide the rolling stock in a non-contact manner is known in the art. More specifically, in this magnetic floating system, the rolling stock is are supported and guided in a non-contact manner by a magnetic attractive force or magnetic repulsive force applied to two parallel rails.

The magnetic floating type rolling stock which is allowed to run by being supported and guided by a two-rail track having two parallel rails is provided with a magnetic attractive or repulsive device protruding between the rails from the bottom thereof. Therefore, in the case of a track switching device for the above-described two-rail track, unlike in the case of a conventional track, it is not permitted to provide rails crossing the tracks because of the above-described protruding device.

Therefore, a conventional track switching device for two-rail tracks for the magnetic floating type rolling stock is so designed as illustrated in FIGS. 1(*a*) and 1(*b*), or 2(*a*) and 2(*b*).

In the prior art shown in FIG. 1, a movable member 12 is provided at the joint of a track 10 and a branch track 11 in such a manner that it can be moved perpendicularly to the direction of the track 10. More specifically, the movable member 12 is provided with a first track 12*a* which aligns with the track 10, and a second track 12*b* which aligns with the track 11. The track switching operation is achieved by moving the movable track 12 as shown in FIGS. 1(*a*) and 1(*b*).

However, this conventional track switching device is disadvantageous in the following point. In general, the length of a track switching part in the ultra-high speed railway is five to eight times as long as that in the ordinary railway. Therefore, if such a lengthy track switching part is made into a movable track switching device, it will become a large-scale device. In this case, the driving device for moving the track switching device will require a large drive capacity.

Shown in FIG. 2 is also a conventional method which is an improvement of the prior art illustrated in FIG. 1. In this method, the movable member shown in FIGS. 1(*a*) and 1(*b*) is divided into several movable member 12*a*, 12*b*, 12*c* - - - arranged along the track, whereby, the power of a device for driving a movable member is reduced.

However, this conventional method is also disadvantageous in that a mechanism for driving a number of movable members is necessarily intricate, and that since the moving distances of the several movable members are different from one another in switching the tracks, the control device thereof becomes undoubtedly intricate also.

SUMMARY OF THE INVENTION

Accordingly, an object of this invention is to overcome all of the above-described difficulties accompanying conventional track switching devices provided for two-rail type tracks.

More specifically, an obect of the invention is to provide a track switching device in which a track switching operation can be achieved by a small amount of movement of its movable member, and the number of tracks provided on the movable part is minimized to reduce the weight of the track switching device as a whole, whereby the track switching operation can be completed quickly.

The foregoing object and other objects of the invention have been achieved by the provision of a track swtiching device for two-rail type tracks, which comprises a first movable member having two parallel rails, said first movable member being arranged at the joint of a first track and second and third tracks to which said first track is selectively coupled, each track having two parallel rails. The two rails of said first movable member are arranged in such a manner that when said first movable member is moved to switch the tracks, said two rails of the first movable member are moved between two outer rails of said second and third tracks so that a selected one of said two rails of the first movable member is coupled to a selected one of inner rails of said second and third rails.

The nature, principle and utility of this invention will become more apparent from the following description and the appended claim when read in conjunction with the accompanying drawings, in which like parts are designated by like reference numerals.

DETAILED DESCRIPTION OF THE INVENTION

A first example of this invention will be described with reference to FIGS. 3 and 4.

Figure 1A:
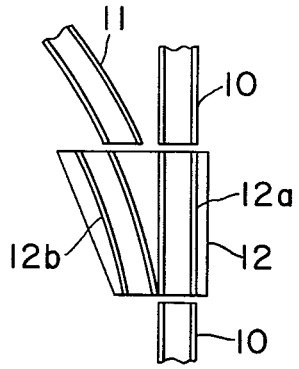
PRIOR ART FIG. 1(a)
FIGS. 1(*a*) and 1(*b*) are explanatory diagrams for a description of one example of a conventional track switching device provided for two-rail type tracks.
Figure 1B:
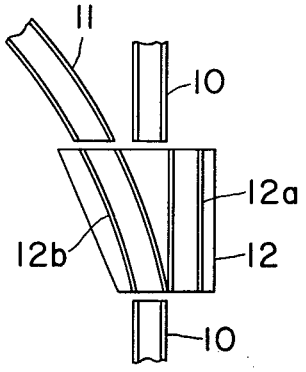
PRIOR ART FIG. 1(b)
Figure 2A:
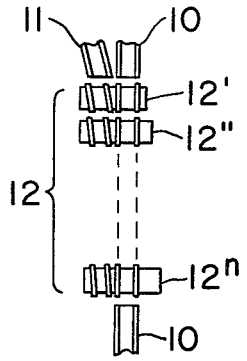
PRIOR ART FIG. 2(a)
FIGS. 2(*a*) and 2(*b*) are also explanatory diagrams for a description of another example of the conventional track switching device for two-rail type tracks.
Figure 2B:
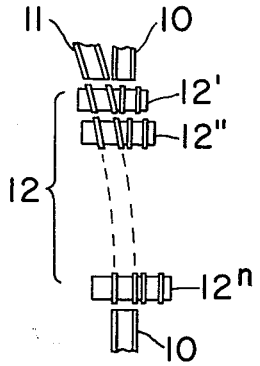
PRIOR ART FIG. 2(b)
Figure 3:
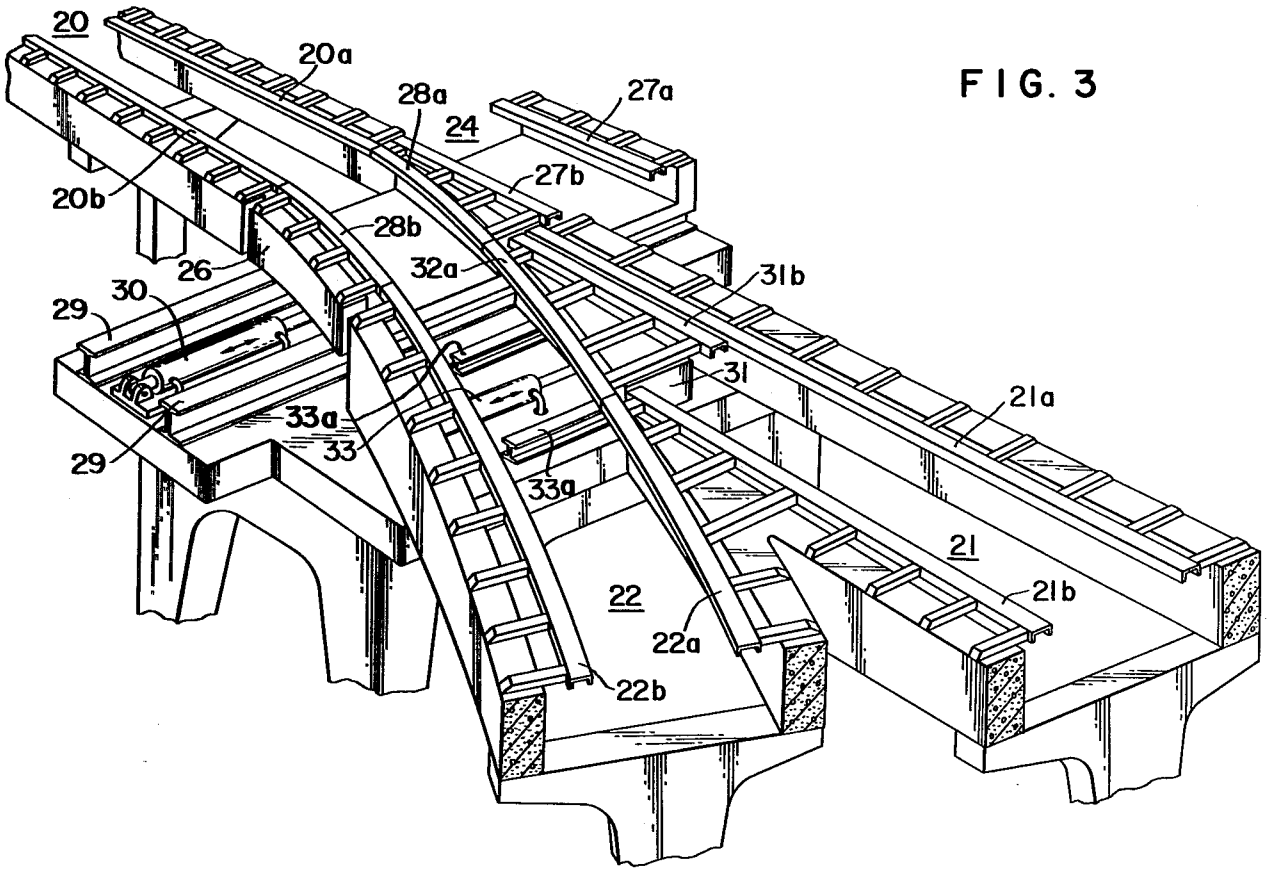
FIG. 3 is a perspective view illustrating a first example of a track switching device providied for two-rail type tracks according to this invention.
Figure 4:
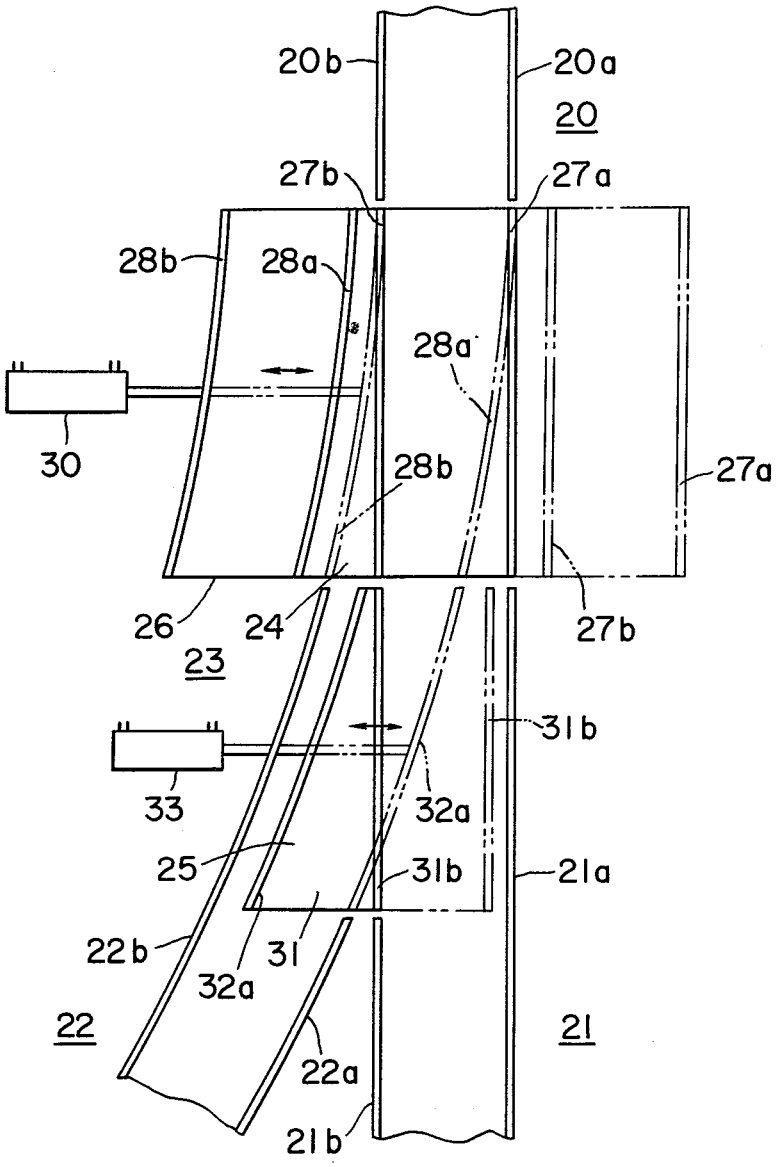
FIG. 4 is an explanatory diagram for a description of the operation of the track switching device shown in FIG. 3.

As is shown in FIGS. 3 and 4, a two-rail type track 20 branches into two two-rail type tracks 21 and 22, and a track switching device 23 according to this invention is provided at the joint of these tracks.

The tracks 20, 21 and 22 comprise pairs of parallel rails 20*a* and 20*b*, 21*a* and 21*b*, and 22*a* and 22*b*, respectively.

In this example, the tracks 20 and 21 run in the same direction, while the tracks 20 and 22 run in different direction as is shown in FIG. 4.

The track switching device 23, as shown in FIGS. 3 and 4, is made up of two movable members 24 and 25 which are arranged in the direction of the track and move in parallel and independently.

The movable member 24 comprises: a base 26 which is adjacent to the track 20 and can move perpendicularly to the direction of the track 20, a track consisting of two parallel rails 27*a* and 27*b* provided on the base 26 for coupling the tracks 20 and 21, and a track consisting of two parallel rails 28*a* and 28*b* on the base 26 for coupling the tracks 20 and 22.

The base 26 is slidably mounted on guide rails 29, and is coupled to a hydraulic cylinder 30 so that it can be moved along the guide rails.

The afore-mentioned movable member 25 comprises: a base 31 which is disposed between the rail 21*a* of the track 21 and the rail 22*b* of the track 22 and is moved perpendicularly to the direction of the track 21; a rail 31*b* provided on the base 31 for coupling to the rail 21*b* of the track 21 to complete this track 21; and a rail 32*a* provided on the base 31, for coupling to the rail 22*a* of the track 22 to complete this track 22.

The base 31 is slidably mounted on guide rails 33*a* and is connected to a hydraulic cylinder 33 so that it can be moved on the guide rails 33*a*.

The operation of the first example of the track switching device according to this invention will be described.

The tracks 20 and 21 can be coupled to each other by operating the hydraulic cylinders 30 and 33 in the same direction. More specifically, as is illustrated in FIG. 4, the bases 26 and 31 are moved left so that the rails 27*a* and 27*b* on the base 26 are in alignment with the rails 20*a* and 20*b*, respectively, and the rail 27*a* is in alignment with the rail 21*a* of the track 21, and that the rail 31*b* on the base 31 is in alingment with the rail 27*b* and the rail 21*b* of the track 21. Thus, these rails are disposed as indicated by the solid lines in FIG. 4.

The operation of the track switching device will be described during movement from the position wherein the track 20 is coupled to the track 21 as described above to the position wherein track 20 is coupled to track 22.

The hydraulic cylinders 30 and 33 are energized to shift the bases 26 and 31 to the right. As a result, as is shown by the dot-dash lines in FIG. 4, the rails 28*a* and 28*b* of the movable member 24 are aligned with the rails 20*a* and 20*b* of the track 20, and the rail 28*b* is aligned with the rail 22*b* of the track 22. At the same time, by the movement of the base 31, the rail 32*a* of the movable track 31 is aligned with the rail 28*a* thus moved and the rail 22*a* of the track 22. Thus, coupling of the tracks 20 and 22 has been completed.

Figure 5:
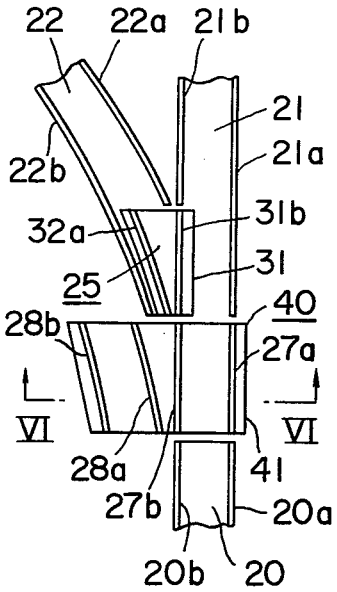
FIG. 5 is an explanatory diagram illustrating a second example of the track switching device according to the invention.
Figure 6:
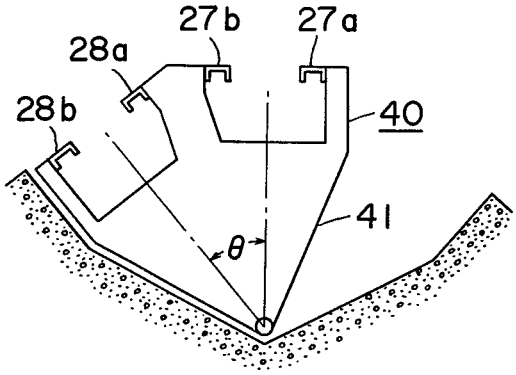
FIG. 6 is a sectional view taken along line VI—VI in FIG. 5.

FIGS. 5 and 6 show a second example of the track switching device according to the invention, in which the movable member 24 is modified. The movable member 24 in FIGS. 3 and 4 is moved horizontally, but the modified movable member in FIGS. 5 and 6 is a rotary type movable track 40 which is designed to rotate for switching the tracks.

The rotary type movable track 40 comprises: a rotary structure 41 which is rotated perpendicularly to the direction of the tracks 20 or 21. Similarly as in the example in FIGS. 3 and 4, a pair of rails 27*a* and 27*b* are provide on one surface of the rotary structure for coupling the track 20 to the track 21, and a pair of rails 28*a* and 28*b* are provided on another surface of the rotary structure for coupling the track 20 to the track 22.

Figure 7:
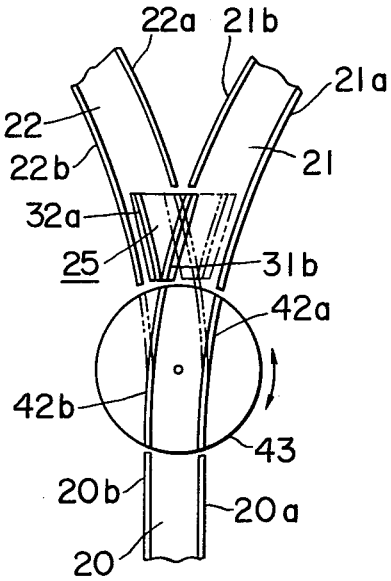
FIG. 7 is an explanatory diagram illustrating a third example of the track switching device according to the invention.

Switching the tracks can be achieved by turning the rotary structure 41 through an angle $\theta$ as shown in FIG. 6. In this case, the stroke of the hydraulic cylinder can be made shorter than that of the hydraulic cylinder in the case of horizontally moving the movable member. A third example of the track switching device is shown in FIG. 7, which is employed where the tracks 21 and 22 are arranged symmetrical with respect to the track 20.

This track switching device comprises a disk-shaped movable member 43 with a track having a pair of curved rails 42*a* and 42*b*. This track on the movable member 43 is designed such that when its one end is in alignment with the track 20, the other end is in alignment with one of the tracks 21 and 22. With this track switching device, switching the tracks can be achieved by turning the disk 43 through the angle of 180°.

The advantage of this example resides in that track switching is achieved merely by the rotation of the disk-shaped movable member and no parts protrude around the track switching section. This feature increases the safety in running rolling stock and simplifies the track supporting structure.

As is apparent from the above description, according to this invention, the movable members for switching the tracks can be made smaller in size, and therefore the power of the driving device for operating the track switching device can be reduced.

In addition, the movable members of the track switching device are smaller in size and lighter in weight, the number of movable members is reduced, and the whole construction of the track switching device can be simplified.

I claim:

1. A track switching device for two-rail type tracks for guiding magnetic floating type rolling stock including drive means with a protruding portion positioned between the two rails of said track, said device comprising first, second and third tracks, first and second movable means, said first movable means having two rails and being positioned at the joint of the first track and the second and third tracks to which said first track is selectively coupled, each of said first, second and third tracks having two parallel rails, said two rails of said first movable means being positioned such that when said first movable means is moved to switch the tracks, said two rails of the first movable means are moved between the two outer rails of said second and third tracks for coupling a selected one of said two rails of the first movable means to a selected one of inner rails of said second and third tracks and for providing sufficient space between said rails for said protruding portion of said vehicle drive means; said second movable means being positioned between said first track and said first movable means and having track means engageable with said first, second, and third tracks and said first movable means.

2. A track switching device as claimed in claim 1 wherein said first, second and third tracks are positioned such that said first and second tracks run in the same direction, and said first and third tracks run in different directions.

3. A track switching device as claimed in claim 2 wherein said track means of second movable means comprises fourth and fifth tracks provided on two different surfaces thereof, and wherein said second movable means is turned through a predetermined angle in a plane perpendicular to the direction of running said first and second tracks for coupling a selected one of said fourth and fifth tracks to a selected one of said second and third tracks.

4. A track switching device as claimed in claim 1 wherein said second and third tracks are arranged symmetrically with respect to said first track, said track means of said second movable means further comprising a disk-shaped movable member having a fourth track positioned thereon such that when one end of said fourth track is in alignment with said first track, the other end thereof is in alignment with one of said second and third tracks through said first movable means, said disk-shaped movable means being turned through 180° degrees for switching said tracks.

* * * * *